United States Patent [19]

Weaver

[11] 4,094,482

[45] June 13, 1978

[54] DECK MOUNT FOR FISHING MOTOR

[75] Inventor: Lester C. Weaver, Fayetteville, Ark.

[73] Assignee: Shakespeare of Arkansas Inc., Fayetteville, Ark.

[21] Appl. No.: 751,469

[22] Filed: Dec. 17, 1976

[51] Int. Cl.[2] ..... B63H 21/26

[52] U.S. Cl. ..... 248/4; 115/17

[58] Field of Search ..... 248/4, 291; 115/17, 115/18 R

[56] References Cited

U.S. PATENT DOCUMENTS

| | | | |
|---|---|---|---|
| 3,604,674 | 9/1971 | Wilkerson | 248/4 |
| 3,724,790 | 4/1973 | Harris et al. | 248/4 |
| 3,870,258 | 3/1975 | Shimanckas et al. | 248/4 |
| 3,874,318 | 4/1975 | Langley | 248/4 |
| 3,954,080 | 5/1976 | Weaver | 248/4 |
| 4,013,249 | 3/1977 | Meyer et al. | 248/4 |

*Primary Examiner*—Marion Parsons, Jr.

*Attorney, Agent, or Firm*—Hamilton, Renner & Kenner

[57] ABSTRACT

A mount having a base bracket for mounting the motor tube of a fishing motor on a boat deck for swinging between a vertical operating position and a horizontal stowed position over the deck. A clamping yoke for holding the motor tube is swiveled on the bracket and a manually releasable latch pivoted on the bracket selectively locks the clamping yoke in the operating and stowed positions when the yoke is swung to either position.

6 Claims, 7 Drawing Figures

DECK MOUNT FOR FISHING MOTOR

BACKGROUND OF THE INVENTION

A number of prior devices for mounting fishing motors on a boat deck have required expensive and complicated linkages for moving the motor tube between the operating and the stowed positions. Certain of said devices have not had means for positively locking the motor in the operating and stowing positions and in others the locking means requires separate manipulation to become engaged in the locking positions.

SUMMARY OF THE INVENTION

It is an object of the present invention to provide an improved simple and inexpensive deck mount for a fishing motor having a base bracket and a motor tube clamping yoke swiveled thereon for swinging between operating and stowed positions.

Another object is to provide an improved deck mount having novel latch means biased for automatically locking the motor tube in either position and means for shielding the latch means from accidental disengagement.

A further object is to provide an improved deck mount having novel biased latch means which is quickly and easily released with the fingers.

Another object is to provide an improved deck mount having an improved clamping yoke adapted automatically to lockingly engage the latch means when the motor tube held in the yoke is swung to either operating or stowed position.

A still further object is to provide improved abutment means on the base bracket to limit the movement of the latch means and the swinging of the yoke in either direction.

Still another object is to provide an improved clamping yoke adapted to clamp a range of sizes of motor tubes.

These and other objects are accomplished by the present improved construction, a preferred embodiment of which is shown by way of example in the accompanying drawings and hereinafter described in detail. Various modifications and changes in details of construction are comprehended within the scope of the appended claims.

DESCRIPTION OF A PREFERRED EMBODIMENT

Figure 1:
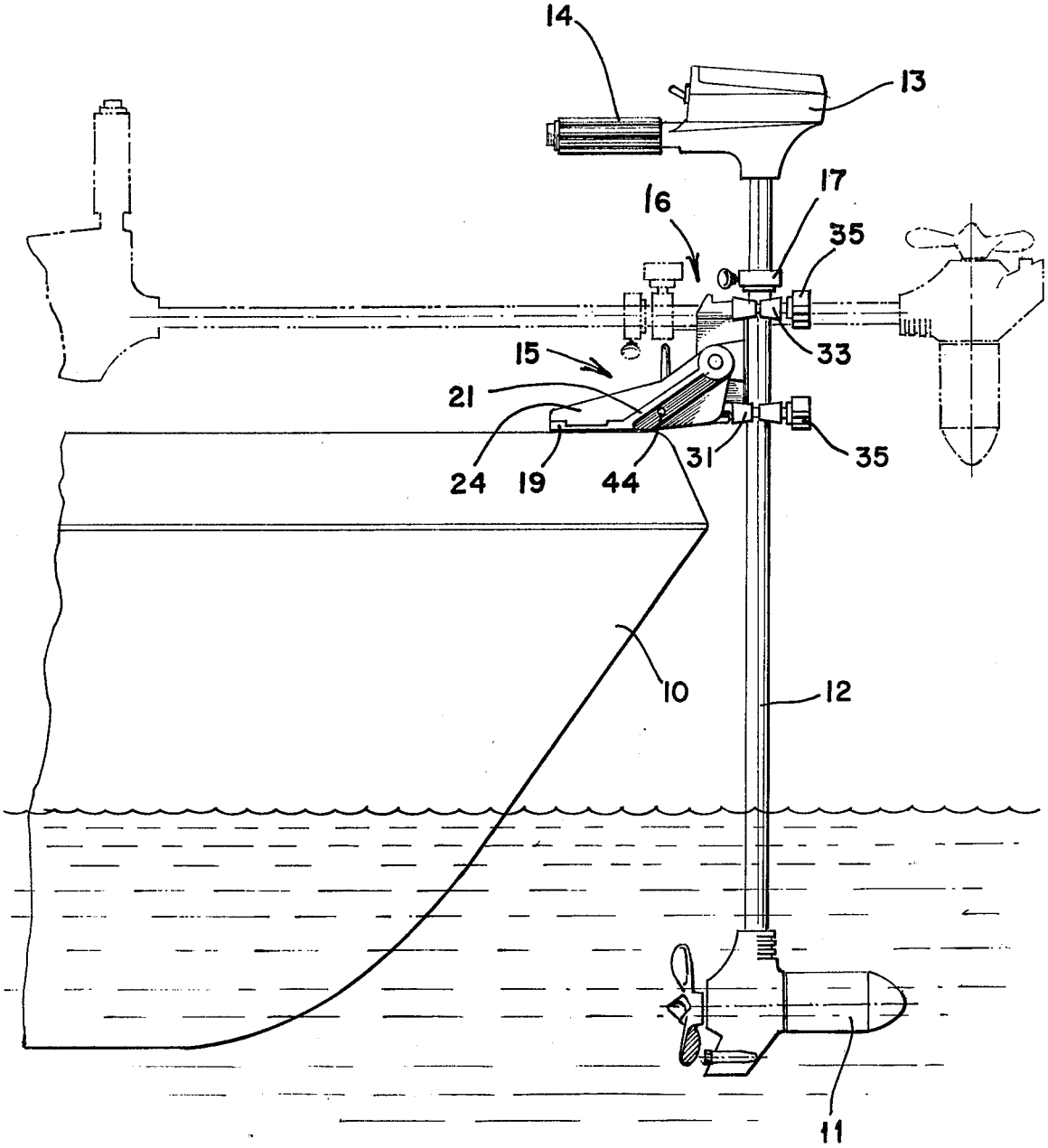
FIG. 1 is a side elevation of the improved deck mount secured to a boat deck and holding the motor tube of an electric fishing motor, the motor tube being shown in full lines in the vertical operating position and in phantom lines in the horizontal stowed position.

Referring to FIG. 1, the improved deck mount is shown attached to the forward deck of a boat 10, the electric motor 11 being shown submerged in full lines with the motor tube 12 in vertical operating position. The usual housing 13 containing switches and controls for the motor is mounted on the upper end of tube 12. Housing 13 preferably has a handle or tiller 14 projecting rearwardly therefrom for steering the thrust of the motor 11. The stowed position of the motor, motor tube and control housing is indicated in phantom lines.

The base bracket of the deck mount is indicated generally at 15 and may be bolted to the periphery of the boat deck at any desired location which has sufficient area and allows adequate clearance between the boat and the motor tube in the operating position. The motor tube is clamped in a symmetrical yoke indicated generally at 16, swiveled on bracket 15, and a collar 17 is adjustably clamped on the motor tube above the swivel yoke 16 to vertically position the motor 11 in the operating position. Preferably, the motor tube is retracted in the yoke over the boat in the horizontal stowed position, as indicated in the phantom lines.

Referring to FIGS. 2–7, the bracket 15 has a horizontal base flange 19 which is secured to the boat deck by bolts 20. Inclined side flanges 21 extend forwardly from the sides of the base flange 19 and terminate in opposed ears 22 in which a pin 23 is journaled for mounting the swivel yoke 16 thereon in overhanging relation from the boat deck in the operating position. Vertically disposed ribs 24 within the flanges 21 extend downwardly and rearwardly from the ears 22 and terminate in the arcuate rib 25 at the rear end of the base plate 19. These ribs 24 shield the latch mechanism hereinafter described which is mounted between the ribs from impact and accidental disengagement.

The clamping yoke 16 has a central substantially diamond-shaped body 28 with peripheral side flanges 29. The flanges 29 are provided medially with exterior bosses 30 through which the swivel pin 23 passes. At the ends of the body 28 are mounting pads 31 having V-shaped notches 32 for abutting one side of the motor tube 12. A pair of clamping plates 33 for abutting the opposite side of the motor tube is adjustably secured to the pads 31 by screws 34 and thumb screws 35 which are reversible and adapted to accommodate a range of sizes of motor tubes. Further, by adjusting the screws, sufficient friction is applied to the motor tube to stabilize it in a desired steering position without holding the tiller 14.

Behind the pads 31, the ends of flanges 28 merge into cam lugs 36*a* and 36*b* having cam surfaces 37*a* and 37*b*, and retainer detent notches 38*a* and 38*b*. These cam surfaces and retainer notches cooperate with the improved single latch means pivoted on bracket 15, which will now be described.

The latch means indicated generally at 40 is preferably a symmetrical L-shaped plate preferably having two angular legs 41*a* and 41*b* disposed substantially at 90° to each other and having an enlarged portion 43 at the intersection of the legs. The portion 43 has a pivot pin 44 therein and the ends of the pin are journaled in the side ribs 24. The portion 43 has an exterior abutment face 41′ substantially parallel to leg 41*a* and the flat head 45 of a drive pin 46 is biased against said face 41′ by a latch spring 47 encircling the pin. The pin 46 is slidably mounted in a transverse wall 48 extending between the ribs 24 of bracket 19, and the spring is interposed between wall 48 and the head 45.

The legs 41*a* and 41*b* of the latch plate have rectangular catch apertures 42*a* and 42*b*, respectively, for selectively passing over the ends of cam lugs 36 to engage the radially outer portions of the legs into the detent notches 38*a* and 38*b*, respectively. A V-shaped abutment rib 50 extends transversely between the vertical ribs 24 of base bracket 15, and has a vertical abutment surface 51 for abutting the ribs 29 of swivel yoke 16 in the operating position of FIG. 2, and a horizontal abutment surface 52 for abutting the ribs 29 of swivel yoke 16 in the stowed position of FIG. 3. Thus, lateral loads on the motor tube are transmitted through the abutment rib 50 and swivel pin 23 to the base bracket 15, and the rib aids in preventing overtravel and accidental disengagement of the latch due to impacts on the motor tube.

Figure 2:
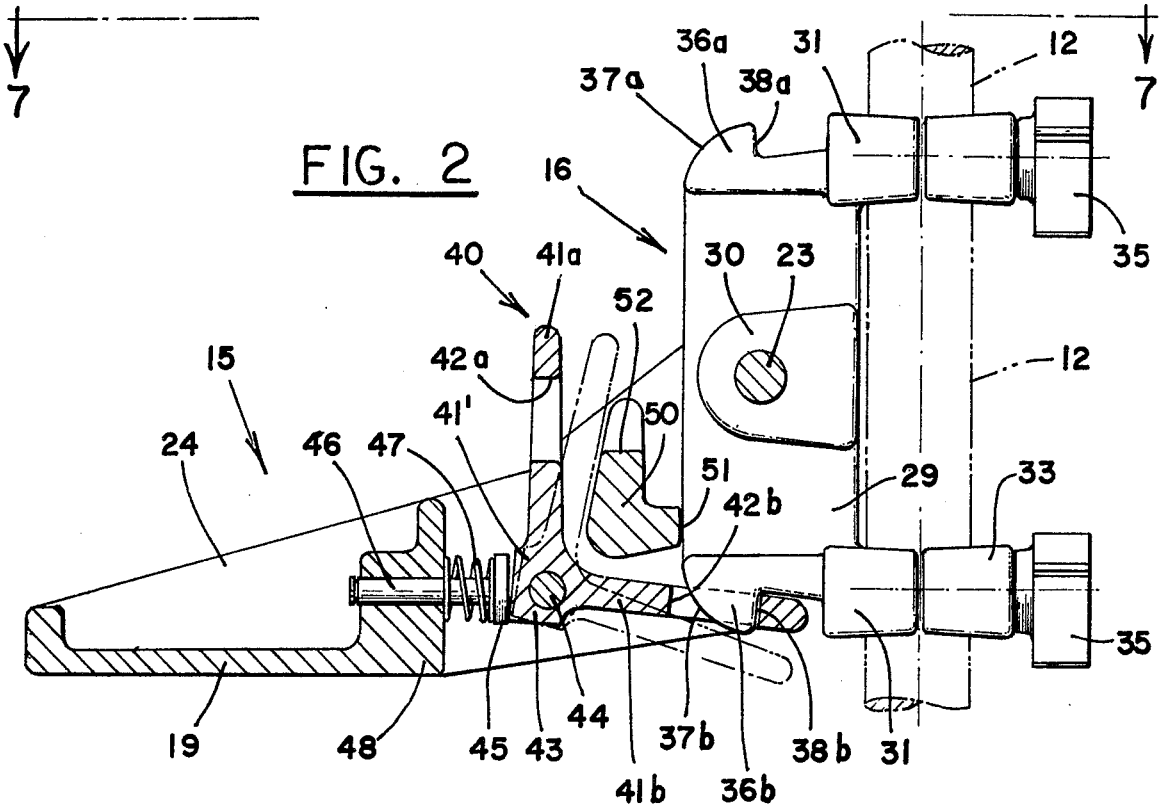
FIG. 2 is an enlarged detached side elevation of the deck mount in the operating position, with parts broken away and in section.

In the operating position of FIG. 2, the flat head 45 of the drive pin engages the abutment face 41' of the intersection portion 43 of the latch 40 at a slight angle such that the leg 41*b* is biased into engagement with the detent notch 38*b* of the yoke 16. In the stowed position of FIG. 3, the latch is rotated slightly counterclockwise past the position of flat abutment between the head 45 and face 41, to create an oppositely disposed angle therebetween such that the leg 41*a* is biased into engagement with the detent notch 38*a*.

Figure 3:
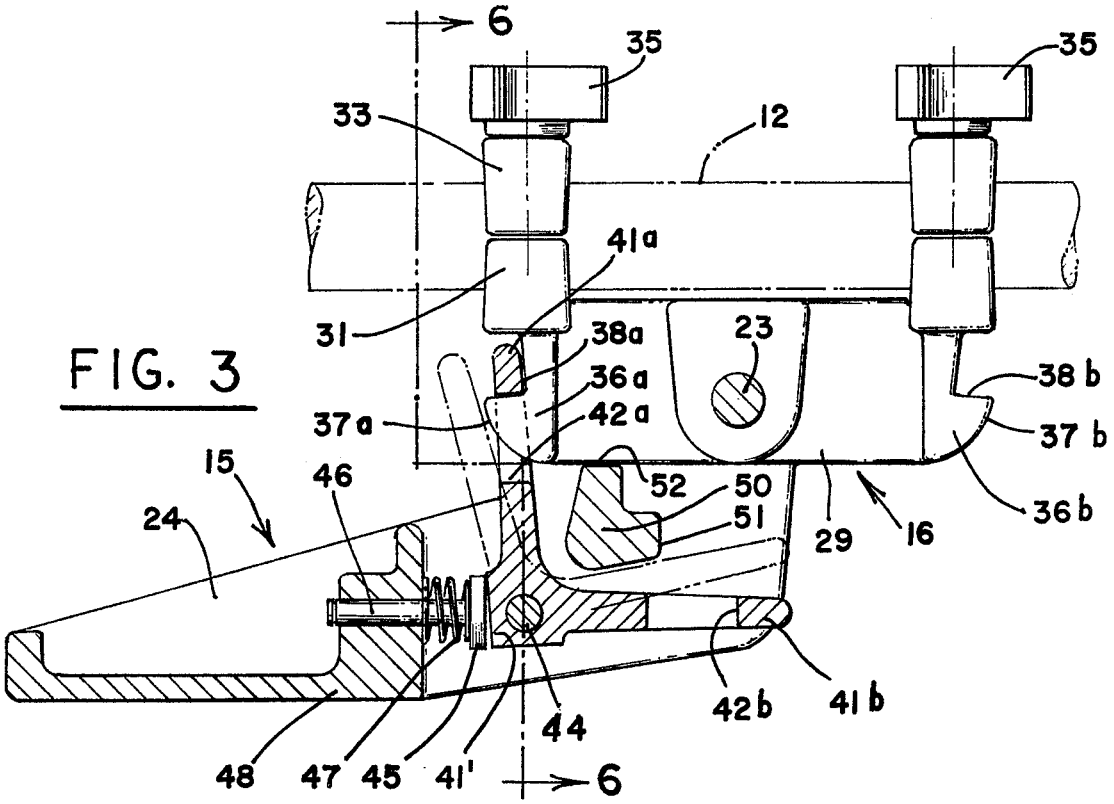
FIG. 3 is a similar view in the stowed position.
Figure 4:
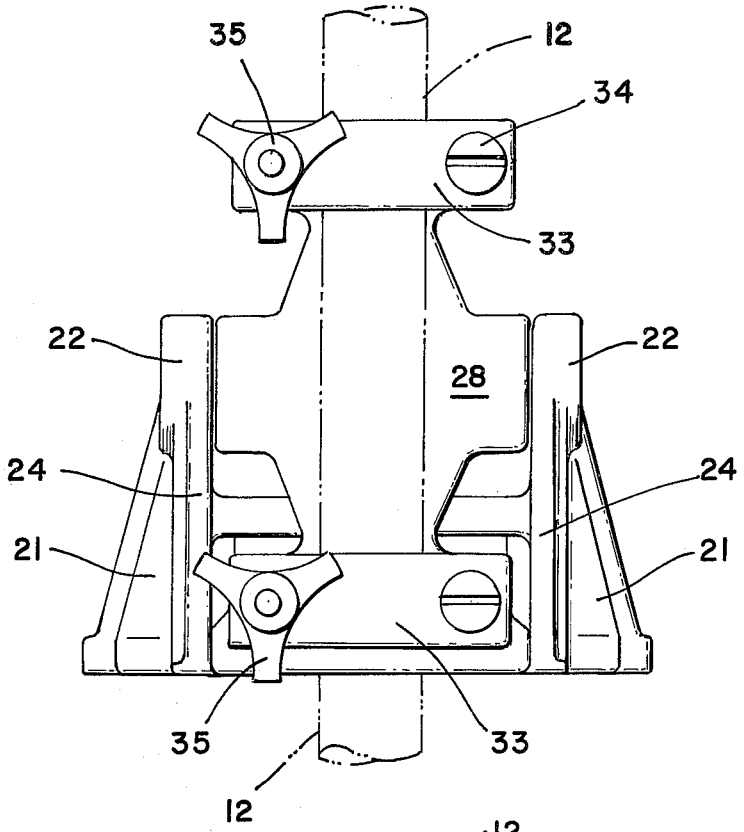
FIG. 4 is a front elevational view in the position of FIG. 2.
Figure 5:
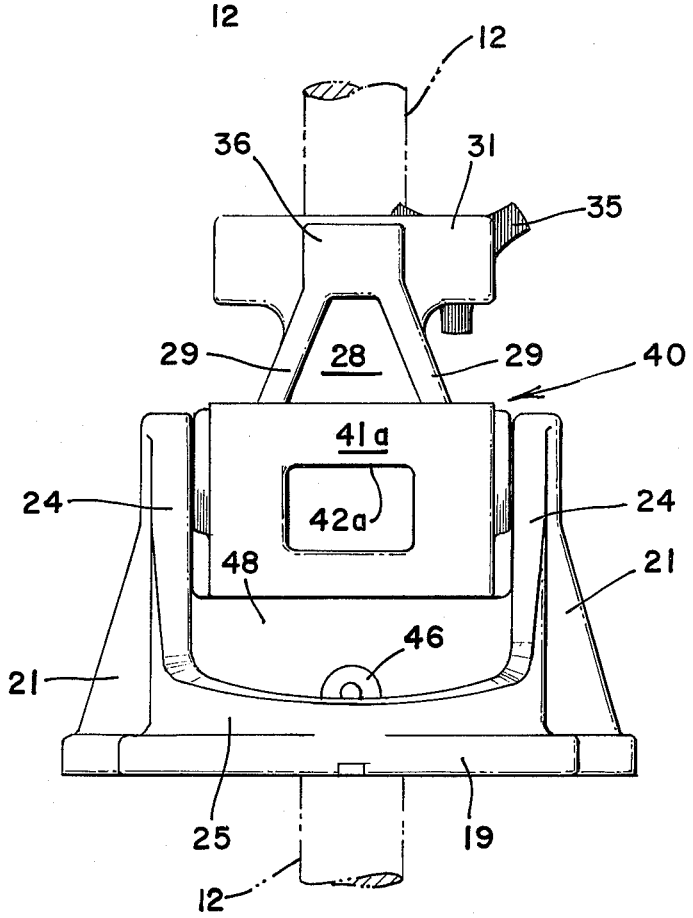
FIG. 5 is a rear elevational view thereof.
Figure 6:
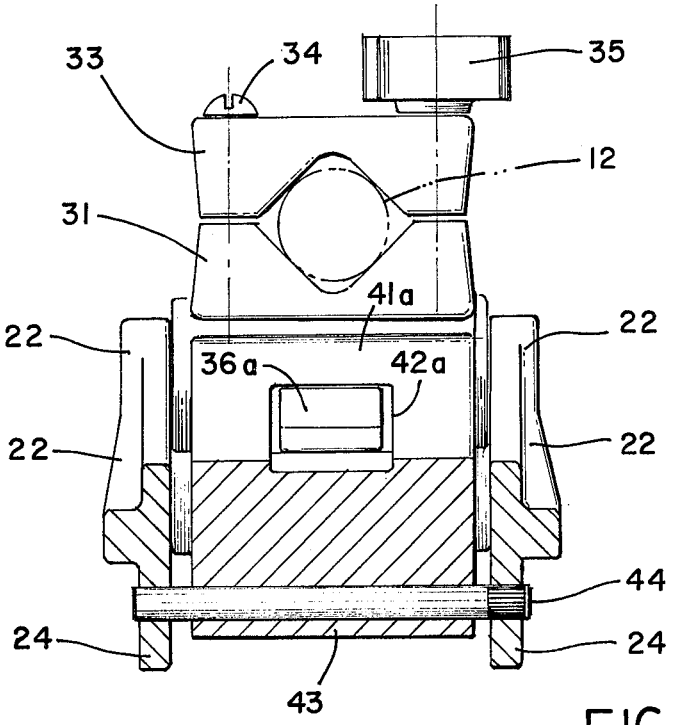
FIG. 6 is a partial sectional view on line 6—6 of FIG. 3.
Figure 7:
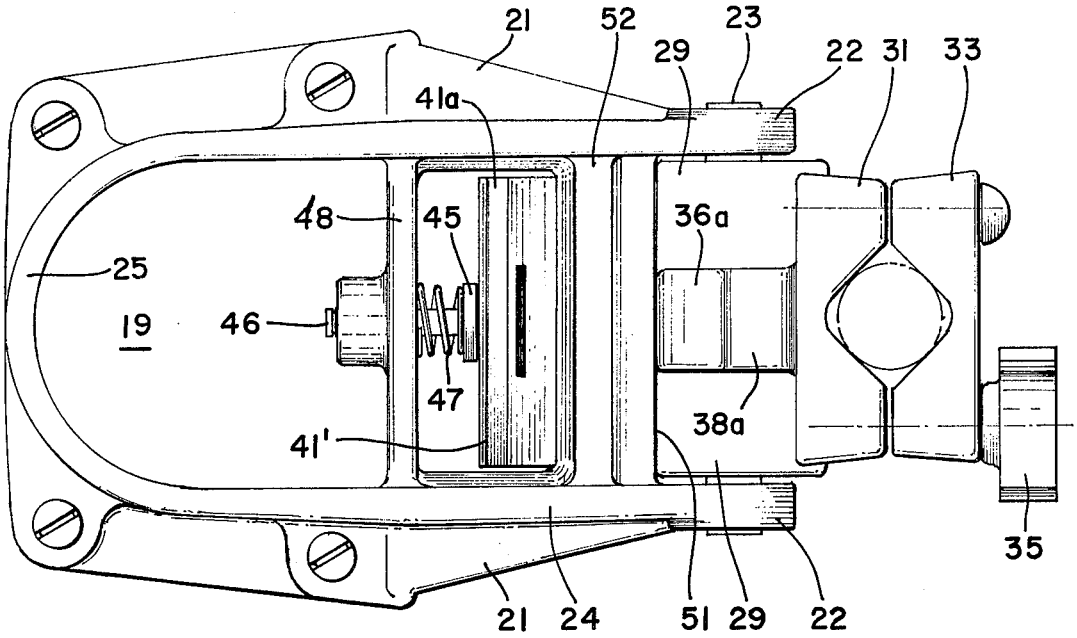
FIG. 7 is a plan elevational view on line 7—7 of FIG. 2.

Assuming that the swivel yoke 16 is in the operating position of FIG. 2, when it is desired to swing the yoke and the motor tube clamped therein to the stowed position of FIG. 3, the fisherman passes on leg 41*a* of the latch to rotate it to the position shown in phantom in FIG. 2. The rear face of abutment rib 50 limits rotation of the latch. This rotation releases leg 41*b* from engagement with the notch, so that the yoke can be swung on pivot pin 23 counterclockwise and pressure on the latch is released so that it is temporarily held in a neutral position by flat abutment between the head 45 of the drive pin and the face 41' of the latch. This neutral position is intermediate the positions of the latch in FIGS. 2 and 3.

As the yoke approaches the position of FIG. 3, the cam surface 37*a* rides over the outer part of leg 41*a* of the latch, further compressing the spring, until the catch aperture 42*a* passes over the cam lug 36*a* and engages the outer portion of leg 41*a* in the notch 38*a*, where it is biased by the spring pressure on the head 45 bearing angularly against the face 41'. In the stowed position the face 52 of rib 50 abuts the outer edges of side flanges 29 of the yoke.

To release the yoke for returning it to the operating position, the fisherman presses upwardly on leg 41*b* of the latch to rotate it counterclockwise to the phantom position of FIG. 3, where the lower face of rib 50 limits further rotation of the latch.

The yoke may now be swung clockwise toward the operating position of FIG. 2, and as it approaches that position the cam surface 37*b* will ride over the outer portion of leg 41*b* to additionally compress spring 47 and allow the lug 36*b* to engage in the detent notch 42*b*, with the flanges 29 of the yoke in abutment with the abutment surface 52 of transverse rib 50. Thus, the latch 40 selectively and automatically locks the swivel yoke and the motor tube therein in the operating and stowed positions.

The improved deck mount is simple, sturdy and inexpensive to make, and is easily operated between operating and stowed position where the motor tube is automatically locked in place, with abutment means on the bracket to transmit lateral loads on the motor tube to the bracket, and inhibit overtravel and accidental disengagement of the automatically engaged latch means.

I claim:

1. A deck mount for mounting the motor tube of a fishing motor on a boat deck, comprising a base bracket adapted for attachment to the deck, a yoke for holding the motor tube, means for clamping said motor tube in said yoke, said yoke swiveled on said bracket for swinging said motor tube between vertical operating position and horizontal stowed position, single latch means having two angularly disposed intersecting legs adapted selectively to engage and lock said yoke in operating and stowed positions, said latch means pivoted on said bracket at the intersection of said legs, and spring means bearing against said intersection for biasing said latch means into locking engagement with said yoke in either position.

2. A deck mount as defined in claim 1, wherein said yoke has spaced-apart detent notches for selectively lockingly engaging said legs.

3. A deck mount as defined in claim 2, wherein the yoke has cam surfaces for selectively engaging said legs to compress said spring means and allow the detent notches to engage the legs.

4. A deck mount as defined in claim 1, wherein the leg engaging the yoke in either position is manually releasable by pressing either leg.

5. A deck mount as defined in claim 4, wherein said base bracket has abutment means for abutting said yoke selectively in operating and stowed positions, and said abutment means limits the releasing movement of said latch legs.

6. A deck mount as defined in claim 1, wherein flange means is provided on the bracket for shielding the latch means against accidental disengagement in the operating and stowed positions.

* * * * *